US012439982B1

(12) United States Patent
Eccles

(10) Patent No.: US 12,439,982 B1
(45) Date of Patent: Oct. 14, 2025

(54) TWO-PART GLOVE SYSTEM

(71) Applicant: Benjamin Russ Eccles, Chicago, IL (US)

(72) Inventor: Benjamin Russ Eccles, Chicago, IL (US)

( * ) Notice: Subject to any disclaimer, the term of this patent is extended or adjusted under 35 U.S.C. 154(b) by 0 days.

(21) Appl. No.: 18/636,355

(22) Filed: Apr. 16, 2024

Related U.S. Application Data

(60) Provisional application No. 63/539,478, filed on Sep. 20, 2023.

(51) Int. Cl.
*A41D 19/015* (2006.01)
*A41D 19/00* (2006.01)

(52) U.S. Cl.
CPC ..... *A41D 19/0006* (2013.01); *A41D 19/001* (2013.01); *A41D 19/0048* (2013.01); *A41D 19/01558* (2013.01)

(58) Field of Classification Search
CPC ..... A41D 19/01552; A41D 19/01558; A63B 71/143
See application file for complete search history.

(56) References Cited

U.S. PATENT DOCUMENTS 1,358,823 A * 11/1920 Burden ..... A41D 19/015 2/21
1,358,824 A * 11/1920 Burden ..... A41D 19/015 2/21
5,329,639 A 7/1994 Aoki
5,898,938 A * 5/1999 Baylor ..... A63B 71/143 2/161.1
6,105,162 A * 8/2000 Douglas ..... A41D 13/0562 2/161.1
6,195,803 B1 3/2001 Russell et al.
8,771,820 B1 7/2014 Goodspeed
9,009,868 B2 * 4/2015 Mazzarolo ..... A41D 19/01523 2/163
9,101,170 B2 8/2015 Stone et al.
11,000,085 B2 5/2021 Rodriguez
2008/0313787 A1 * 12/2008 Dillenschneider ..... A41D 19/01552 2/158
2014/0143925 A1 5/2014 Chorne
2018/0296058 A1 * 10/2018 Firouzman ..... A47L 13/18

FOREIGN PATENT DOCUMENTS

DE 3203023 A1 8/1983
GB 2572075 A 9/2019

* cited by examiner

*Primary Examiner* — Tajash D Patel
(74) *Attorney, Agent, or Firm* — John Rizvi; John Rizvi, P.A.—The Patent Professor ®

(57) ABSTRACT

A two-part glove system may include a glove core suitably sized and configured to enclose a wearer's hand and a glove grip detachably attachable to the glove core. A grip securing assembly may facilitate detachable attachment of the glove grip to the glove core. Accordingly, in typical application, the two-part glove system may be assembled on the wearer's hand by initially deploying the glove core on the wearer's hand. The glove grip may then be deployed on the glove core. The grip securing assembly may be deployed to secure the glove grip to the glove core. The glove grip can be replaced on the glove core as the glove grip becomes worn over repeated or prolonged usage.

20 Claims, 7 Drawing Sheets

TWO-PART GLOVE SYSTEM

CROSS-REFERENCE TO RELATED APPLICATIONS

This application claims the benefit of U.S. Provisional Patent Application Ser. No. 63/539,478, filed on Sep. 20, 2023, which is incorporated by reference herein in its entirety.

FIELD OF THE INVENTION

The present invention relates generally to gloves, and more particularly, to a two-part glove system having a glove grip which can be replaced as the glove grip becomes worn over repeated or prolonged usage.

BACKGROUND OF THE INVENTION

Athletic, vocational, and other activities may commend or require the use of gloves to prevent blistering or otherwise protect the hands of the participant. In some cases, gloves may enhance the grip of the wearer on a bat, ball, tool, workpiece, or other object. For example, athletes such as golfers, baseball players, and tennis players may wear special gloves for enhanced gripping capability. Players in the game of soccer, particularly goalies, may wear gloves to enhance their capacity to grip the ball during play. Gloves worn by wearers in sports, vocations, and other endeavors may require a snug fit to the hand of the wearer. If it is too loose, the glove may abrade the hand of the wearer or may bunch, resulting in discomfort and possibly irritation to the wearer's hand.

Commonly used athletic and vocational gloves may tend to become prematurely worn, abraded, and torn at their palm covering areas. The palm portion of the glove may frictionally contact the object. Over repeated or prolonged use of the glove, such frictional contact may cause thinning, wearing, and/or tearing of the palm portion of the glove.

When the palm portion of a glove has become torn through repeated or prolonged use, the glove may be deemed unusable and non-functional and discarded and replaced. Some types of gloves, however, such as golf and other types of athletic gloves, may be expensive. Discarding and replacing such gloves due to usage and wear may thus be undesirable.

Accordingly, there is need for a two-part glove system having a glove grip which can be replaced as the glove grip becomes worn over repeated or prolonged usage.

SUMMARY OF THE INVENTION

The present invention is directed to a two-part glove system having a glove grip which can be replaced as the glove grip becomes worn over repeated or prolonged usage. An illustrative embodiment of the two-part glove system may include a glove core. The glove core may be suitably sized and configured to enclose a wearer's hand. A glove grip may be detachably attached to the glove core. A grip securing assembly may facilitate detachable attachment of the glove grip to the glove core. The grip securing assembly may include at least one securing assembly tab on the glove grip. At least one grip securing element may be provided on the securing assembly tab and at least one core securing element may be provided on the glove core, respectively. The grip securing element may be configured to detachably engage the grip securing element, respectively, to facilitate detachable attachment of the glove grip to the glove core. Accordingly, in typical application of the two-part glove system, the glove core may initially be deployed on the wearer's hand. The glove grip may then be deployed on the glove core. The grip securing element or elements on the securing assembly tab or tabs of the glove grip may be attached to the respective companion core securing element or elements on the glove core to secure the assembled glove system on the hand. In use, the wearer may grip a bat, tool, or workpiece with the glove grip. After the glove grip wears out over a period of repeated or prolonged use of the glove system, the worn glove grip can be selectively detached from the glove core and discarded. A replacement glove grip may be attached to the glove core for continued use of the glove system.

In an illustrative implementation of the invention, a two-part glove system having a glove grip which can be replaced as the glove grip becomes worn over repeated or prolonged usage may include a glove core. The glove core may be suitably sized and configured to enclose the wearer's hand. A glove grip may be detachably attached to the glove core. The glove grip may include a plurality of grip digits. A grip securing assembly may facilitate detachable attachment of the grip digits on the glove grip to the glove core. The grip securing assembly may include at least one securing assembly tab on the grip digits. At least one grip securing element may be provided on each securing assembly tab and at least one core securing element may be provided on the glove core, respectively. The grip securing element may be configured to detachably engage the grip securing element, respectively, to facilitate detachable attachment of the glove grip to the glove core. Accordingly, in typical application of the two-part glove system, the glove core may initially be deployed on the wearer's hand. The glove grip may then be deployed on the glove core. The grip securing element or elements on the securing assembly tab or tabs of the glove grip may be attached to the respective companion core securing element or elements on the glove core to secure the assembled glove system on the hand. In use, the wearer may grip a bat, tool, or workpiece with the glove grip. After the glove grip wears out over a period of repeated or prolonged use of the glove system, the worn glove grip can be selectively detached from the glove core and discarded. A replacement glove grip may be attached to the glove core for continued use of the glove system.

In an illustrative implementation of the invention, a two-part glove system having a glove grip which can be replaced as the glove grip becomes worn over repeated or prolonged usage may include a glove core. The glove core may be suitably sized and configured to enclose the wearer's hand. The glove core may include a core palm and a plurality of core digits extending from the core palm. A glove grip may be detachably attached to the glove core. The glove grip may include a plurality of grip digits. A grip securing assembly may facilitate detachable attachment of the glove grip to the glove core. The grip securing assembly may include a plurality of securing assembly tabs on the grip digits, respectively. At least one grip securing element may be provided on each securing assembly tab and at least one core securing element may be provided on the glove core, respectively. The grip securing element may be configured to detachably engage the grip securing element, respectively, to facilitate detachable attachment of the glove grip to the glove core. Accordingly, in typical application of the two-part glove system, the glove core may initially be deployed on the wearer's hand. The glove grip may then be deployed on the glove core by inserting the core digits of the glove core into the respective grip digits of the glove grip. The grip securing element or elements on the securing assembly tab or tabs of the glove grip may be attached to the respective companion core securing element or elements on the glove core to secure the assembled glove system on the hand. In use, the wearer may grip a bat, tool, or workpiece with the glove grip. After the glove grip wears out over a period of repeated or prolonged use of the glove system, the worn glove grip can be selectively detached from the glove core and discarded. A replacement glove grip may be attached to the glove core for continued use of the glove system.

In a second aspect, the glove core may be padded.

In another aspect, the glove core may include a core rear panel. A core side panel may extend from the core rear panel. A core front panel may extend from the core side panel. The core rear panel, the core side panel and the core front panel may be suitably sized and configured to cover or enclose the hand of the wearer.

In another aspect, a core wrist portion may extend from the core palm of the glove core. The core wrist portion may be suitably sized and configured to encircle the wrist of the wearer.

In another aspect, the core wrist portion may include a core wrist portion strap.

In another aspect, the core wrist portion strap of the core wrist portion may be elastic.

In another aspect, at least one logo may be provided on the core rear panel of the glove core.

In another aspect, the glove grip may include a grip palm. The grip palm may be suitably sized and configured to cover the palm on the hand of the wearer. The grip digits may extend from the grip palm.

In another aspect, the grip palm of the glove grip may include a grip backing. Each grip digit may include a corresponding digit sheath on the grip backing. Each digit sheath may have a sheath interior sized and configured to receive the corresponding core digit of the glove core in deployment of the glove grip on the glove core.

In another aspect, the grip backing of the glove grip may have a backing face which faces the glove core and a grip face which is opposite the backing face.

In another aspect, a grip wrist portion may extend from the grip palm of the glove grip. The grip wrist portion may be suitably sized and configured to encircle the core wrist portion of the glove core.

In another aspect, the grip wrist portion of the glove grip may include an elongated grip wrist portion strap. A wrist securing assembly may be provided on the grip wrist portion strap. The wrist securing assembly may be suitably configured to secure the grip wrist portion strap of the grip wrist portion around the core wrist portion of the glove core.

In another aspect, the core securing elements of the grip securing assembly may be provided on the core rear panel of the glove core.

In another aspect, the core securing elements of the grip securing assembly may be provided at the junction between the core palm and the respective core digits of the glove core.

In another aspect, the grip securing elements and the core securing elements of the grip securing assembly may include magnets, hook and loop fasteners, and/or snaps.

In another aspect, the securing assembly elements of the wrist securing assembly may include magnets, hook and loop fasteners, and/or snaps.

In another aspect, the glove grip may include a latex material or combinations of latex and other materials.

In another aspect, the glove core may include a latex material and/or a knitted material.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
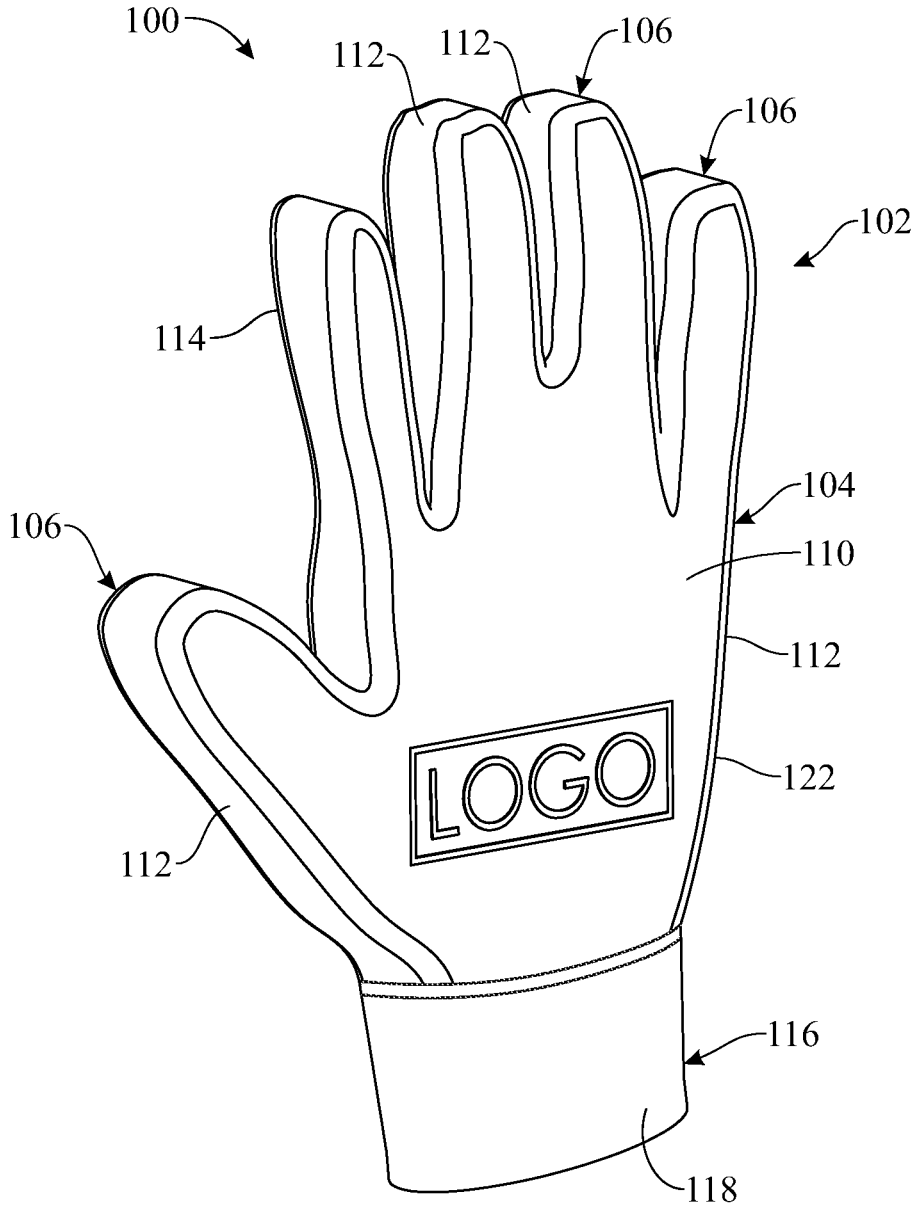
FIG. 1 presents a rear perspective view of an exemplary glove core of a two-part glove system in accordance with an illustrative embodiment of the present invention.

The following detailed description is merely exemplary in nature and is not intended to limit the described embodiments or the application and uses of the described embodiments, unless the claims state otherwise. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise. As used throughout the specification and claims, the term "comprising" can also encompass the terms "consisting essentially of" and "consisting of". The term "about" has the meaning reasonably ascribed to it by a person skilled in the art when used in conjunction with a stated numerical value or range, i.e., denoting from the exact stated value or range to somewhat more or somewhat less than the stated value or range, from a deviation of from 0% with respect to the stated value or range to up to and including 10% of the stated value or range in either direction.

Shown throughout the figures, the present invention is directed toward a two-part glove system having a glove grip which can be replaced as the glove grip becomes worn over repeated or prolonged usage.

Referring initially to FIGS. 1-7, a two-part glove system, hereinafter glove system 100, is illustrated in accordance with an exemplary embodiment of the present invention. As shown for instance in FIG. 3B, the glove system 100 may include a glove core 102. The glove core 102 may be suitably sized and configured to enclose a wearer's hand (not illustrated). A glove grip 130 may be detachably attached to the glove core 102. A grip securing assembly 158 may facilitate detachable attachment of the glove grip 130 to the glove core 102. The grip securing assembly 158 may include at least one securing assembly tab 160 on the glove grip 130. At least one grip securing element 162 may be provided on the securing assembly tab 160 and at least one core securing element 164 may be provided on the glove core 102, respectively, to facilitate detachable attachment of the glove grip 130 to the glove core 102. Accordingly, in typical application of the glove system 100, the glove core 102 may initially be deployed on the wearer's hand. The glove grip 130 may then be deployed on the glove core 102. The grip securing element or elements 162 on the securing assembly tab or tabs 160 of the glove grip 130 may be attached to the respective companion core securing element or elements 164 on the glove core 102 to secure the assembled glove system 100 on the hand. In use, the wearer may grip a bat, tool, or workpiece (not illustrated) with the glove grip 130. After the glove grip 130 wears out over a period of prolonged use of the glove system 100, the worn glove grip 130 can be selectively detached from the glove core 102 and discarded. A replacement glove grip 130 may be attached to the glove core 102 for continued use of the glove system 100.

In some embodiments, the glove grip 130 may include a plurality of grip digits 134. The grip securing assembly 158 may facilitate detachable attachment of the grip digits 134 on the glove grip 130 to the glove core 103. The grip securing assembly 158 may include at least one securing assembly tab 160 on the grip digits 134. At least one grip securing element 162 may be provided on each securing assembly tab 160.

In some embodiments, the glove core 102 may include a core palm 104. A plurality of core digits 106 may extend from the core palm 104.

In some embodiments, the glove core 102 of the glove system 100 may be padded.

As illustrated in FIG. 1, the glove core 102 may include a core rear panel 110. A core side panel 112 may extend from the core rear panel 110. A core front panel 114 may extend from the core side panel 112. The core rear panel 110, the core side panel 112 and the core front panel 114 may be suitably sized and configured to cover or enclose the hand of the wearer.

In some embodiments, a core wrist portion 116 may extend from the core palm 104 of the glove core 102. The core wrist portion 116 may be suitably sized and configured to encircle the wrist of the wearer. The core wrist portion 116 may include a core wrist portion strap 118. In some embodiments, the core wrist portion strap 118 of the core wrist portion 116 may be elastic.

As further illustrated in FIG. 1, in some embodiments, at least one logo 122 may be provided on the core rear panel 110 of the glove core 102. The logo 122 may include the insignia of a sports team, business, or the like.

Figure 2:
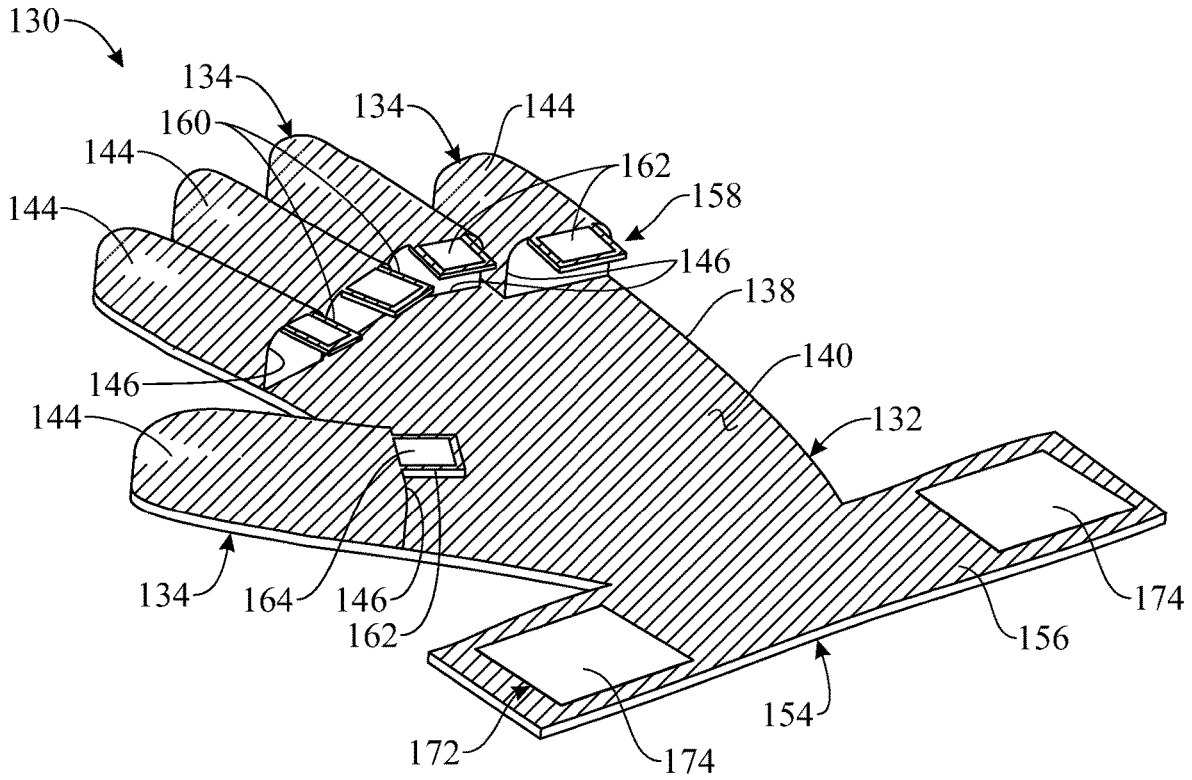
FIG. 2 presents a rear perspective view of an exemplary glove grip of the two-part glove system in accordance with an illustrative embodiment of the present invention.

As illustrated in FIG. 2, in some embodiments, the glove grip 130 may include a grip palm 132. The grip palm 132 may be suitably sized and configured to cover the palm on the hand of the wearer. The grip digits 134 may extend from the grip palm 132.

The grip palm 132 of the glove grip 130 may include a grip backing 138. Each grip digit 134 may include a corresponding digit sheath 144 on the grip backing 138. Each digit sheath 144 may have a sheath interior 146 sized and configured to receive the corresponding core digit 106 of the glove core 102 in deployment of the glove grip 130 on the glove core 102.

Figure 4:
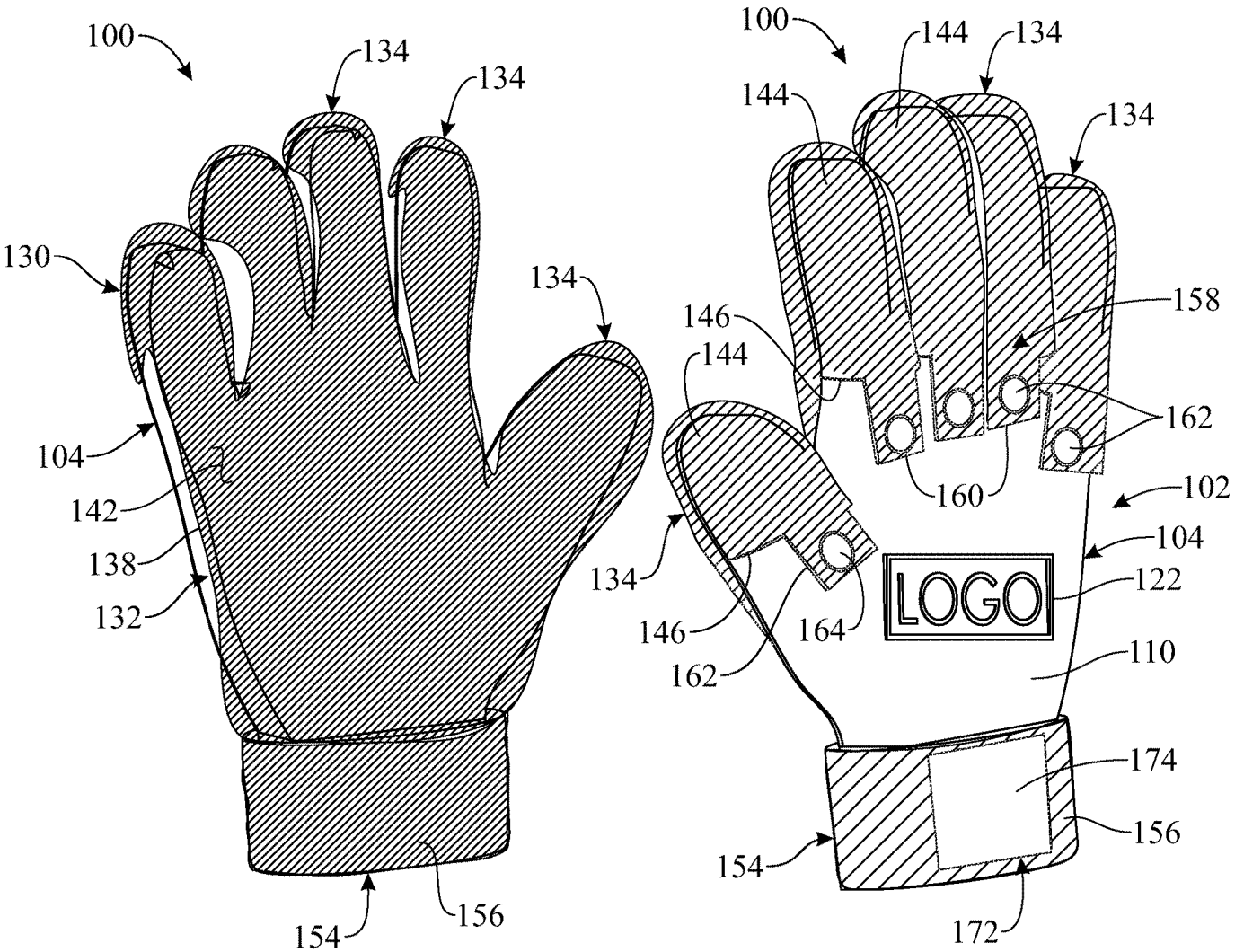
FIG. 4 presents a front view (left-hand rendering) and a rear view (right-hand rendering) of the assembled two-part glove system.
Figure 5:
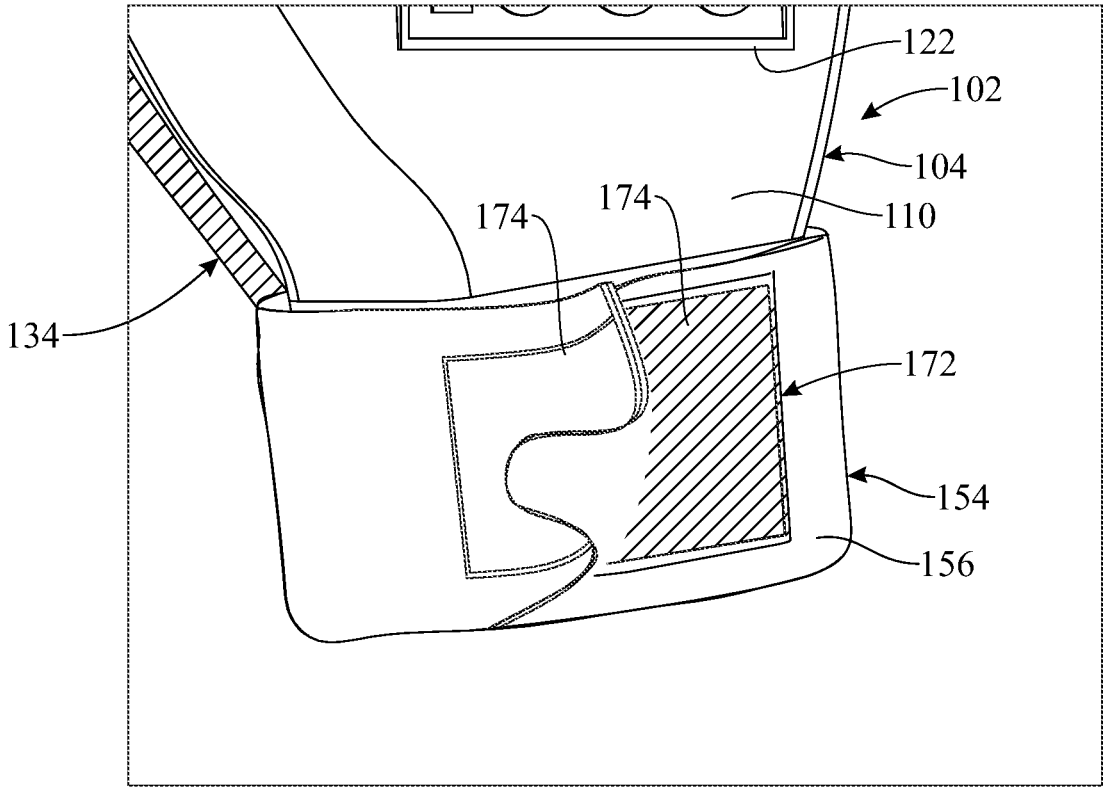
FIG. 5 presents an enlarged sectional view of a typical grip wrist portion on the glove grip in typical fastening of the grip wrist portion on the core wrist portion of the glove core, more particularly illustrating use of hook and loop fasteners as the securing assembly elements of the wrist securing assembly.
Figure 6:
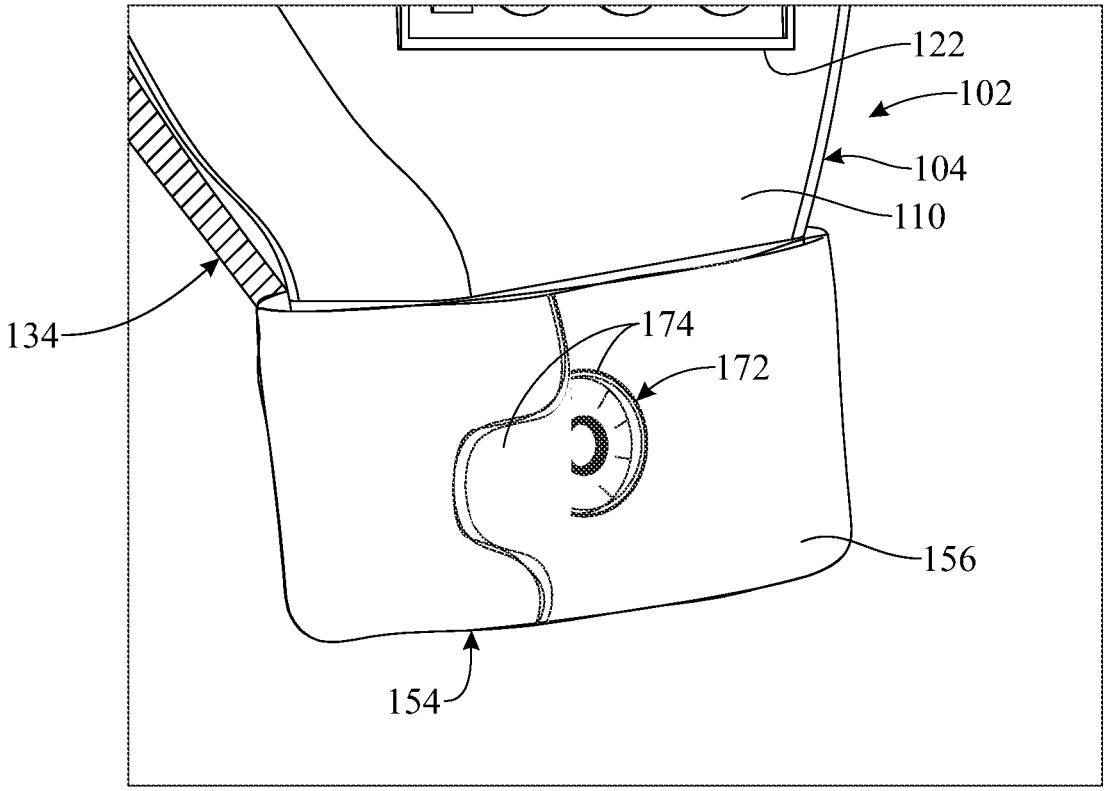
FIG. 6 presents an enlarged sectional view of a typical grip wrist portion on the glove grip in typical fastening of the grip wrist portion on the core wrist portion of the glove core, more particularly illustrating use of snaps as the securing assembly elements of the wrist securing assembly.
Figure 7:
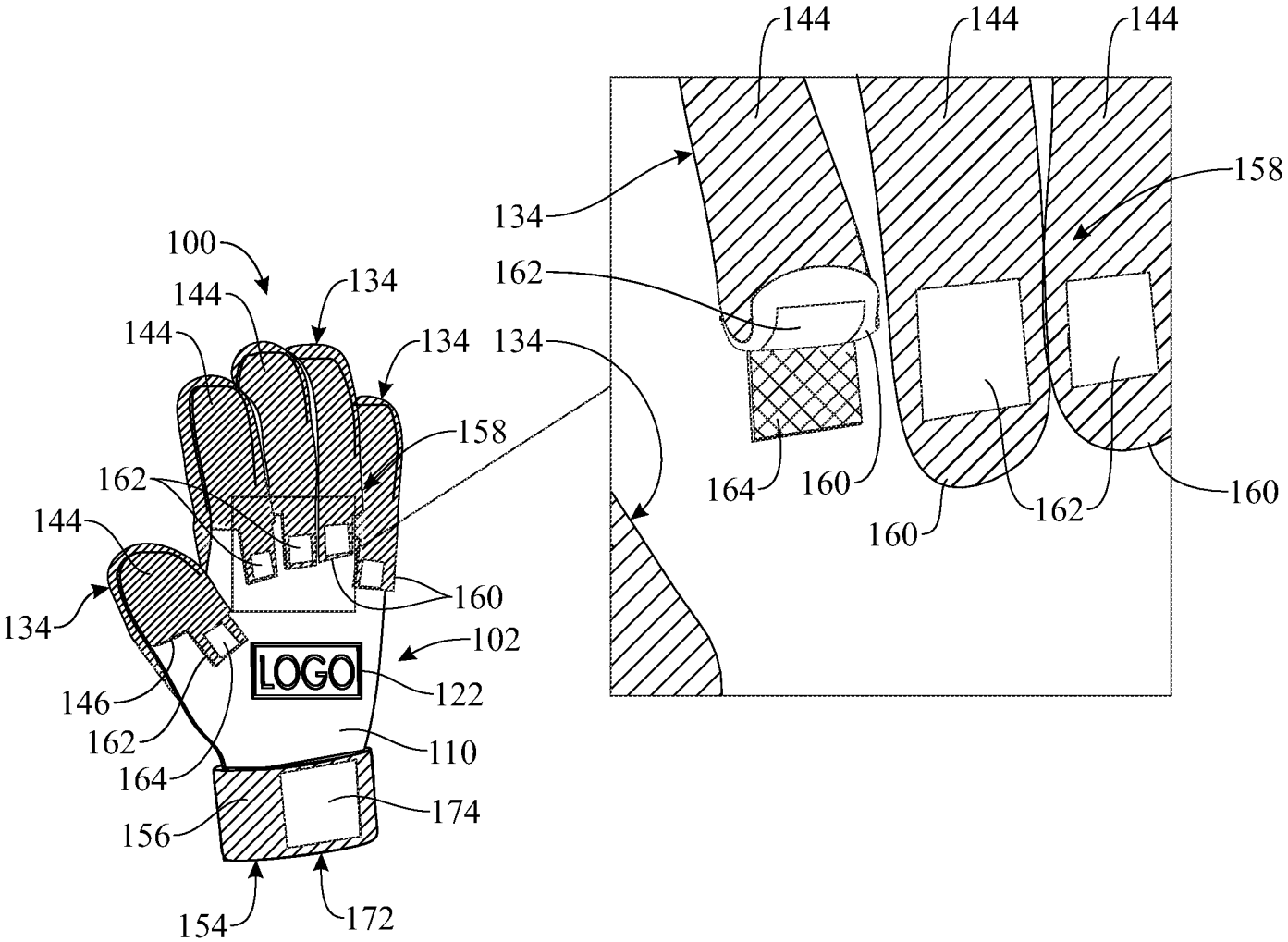
FIG. 7 presents a rear view of the assembled two-part glove system (left-hand rendering) and an enlarged sectional view of an exemplary grip securing assembly in securing of the glove grip to the glove core, more particularly illustrating use of hook and loop fasteners as the grip securing elements and the core securing elements of the grip securing assembly.

As further illustrated in FIG. 2, the grip backing 138 of the glove grip 130 may have a backing face 140 which faces the glove core 102. As illustrated in FIG. 4, the grip backing 138 may have a grip face 142 which is opposite the backing face 140.

A grip wrist portion 154 may extend from the grip palm 132 of the glove grip 130. The grip wrist portion 154 may be suitably sized and configured to encircle the core wrist portion 116 of the glove core 102. In some embodiments, the grip wrist portion 154 of the glove grip 130 may include an elongated grip wrist portion strap 156. A wrist securing assembly 172 may be provided on the grip wrist portion strap 156. The wrist securing assembly 172 may be suitably configured to secure the grip wrist portion strap 156 of the grip wrist portion 154 around the core wrist portion 116 of the glove core 102.

The wrist securing assembly 172 may include securing assembly elements 174 provided on the grip wrist strap 156. The securing assembly elements 174 may include any type of closure mechanism which is suitable for securing the grip wrist strap 156 in the grip wrist portion 154. For example and without limitation, in some embodiments, the securing assembly elements 174 of the wrist securing assembly 172 may include magnets, hook and loop fasteners, and/or snaps.

Figure 3B:
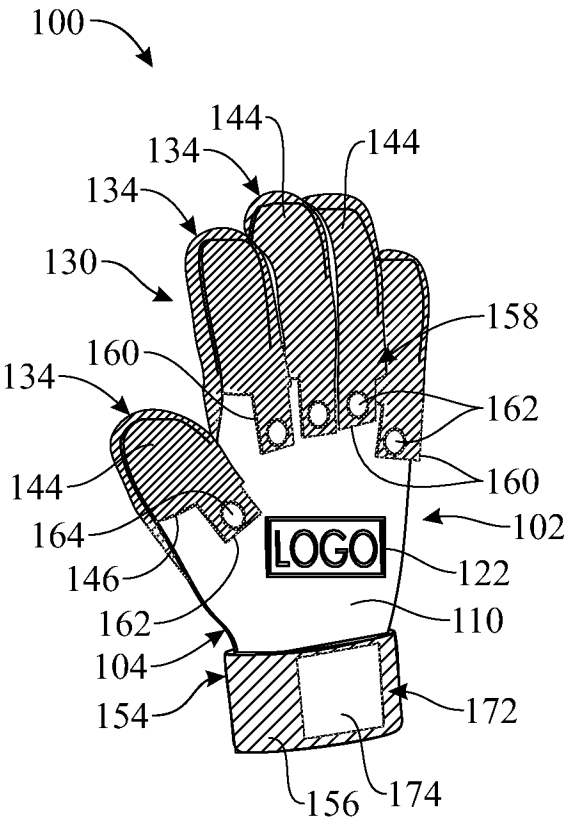
FIG. 3B presents an exploded rear perspective view of the illustrative two-part glove system illustrated in FIG. 3A, with the glove grip attached to the glove core in typical application of the two-part glove system.
Figure 3A:
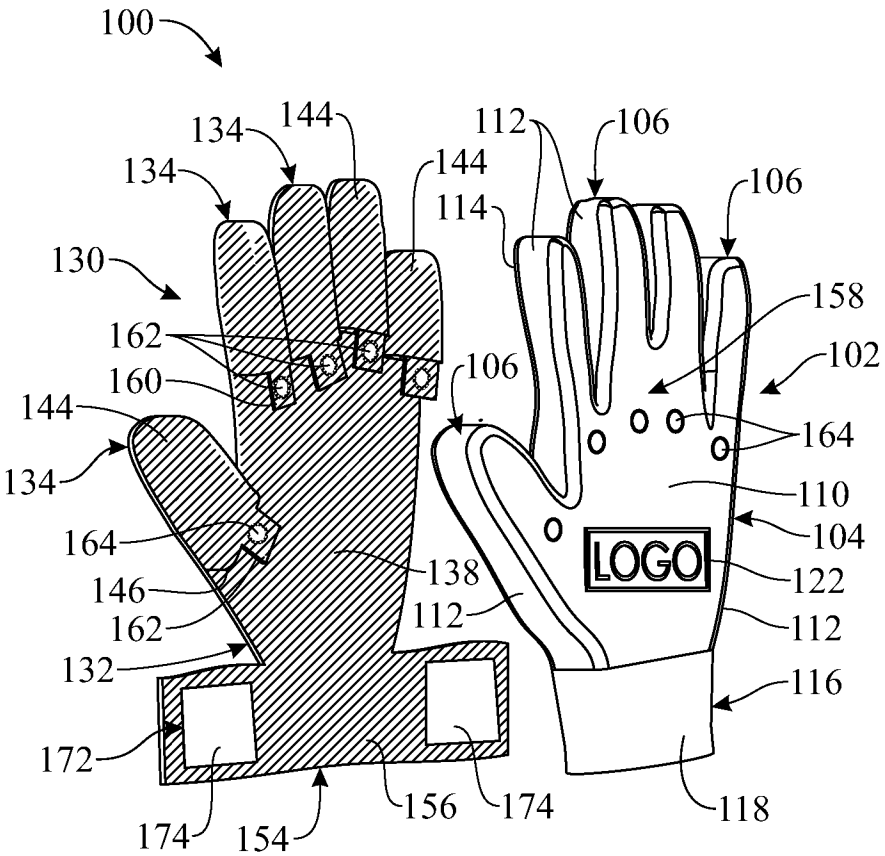
FIG. 3A presents an exploded rear perspective view of the illustrative two-part glove system, with the glove grip detached from the glove core.

As illustrated in FIG. 3A, in some embodiments, the core securing elements 164 of the grip securing assembly 158 may be provided on the core rear panel 110 of the glove core 102. For example, and without limitation, in some embodiments, the core securing elements 164 may be provided at the junction between the core palm 104 and the respective core digits 106 of the glove core 102. The grip securing elements 162 and the core securing elements 164 of the grip securing assembly 158 may include magnets, hook and loop fasteners, and/or snaps, for example and without limitation.

The glove grip 130 of the glove system 100 may include any material or combination of flexible wear resistant materials. For example, and without limitation, in some embodiments, the glove grip 130 may include a latex material or combinations of latex and other materials. The glove core 102 may include a latex material and/or a knitted material, for example and without limitation.

In typical application, the glove system 100 may be assembled on the hand (not illustrated) of a wearer to protect and/or enhance the gripping capability of the hand in athletic pursuits such as soccer, golf, baseball or the like or in any vocational pursuit in which protection and/or enhanced gripping capability of the wearer's hand may be desired. Accordingly, the glove core 102 may initially be placed on the hand (not illustrated) of a wearer. The hand may be inserted through the core palm 104 and the fingers on the hand inserted into the respective core digits 106. The core wrist portion strap 118 of the core wrist portion 116 may snugly engage the wrist of the wearer to secure the glove core 102 on the wearer's hand.

As illustrated in FIGS. 3A and 3B, the glove system 100 may be assembled by next deploying the glove grip 130 on the glove core 102 such that the backing face 140 (FIG. 2) on the grip backing 138 of the glove grip 130 faces the core front panel 114 of the glove core 102. Accordingly, the core digits 106 of the glove core 102 may be inserted into the sheath interiors 146 in the respective digit sheaths 144 of the grip digits 134, with each core digit 106 substantially completely encapsulated by its corresponding digit sheath 144. The grip securing assembly 158 may be deployed by engagement of the grip securing elements 162 on the respective securing assembly tabs 160 with the respective companion core securing elements 164 typically on the core rear panel 110 of the glove core 102. The grip wrist portion strip 156 may be wrapped around the core wrist portion strap 118 of the core wrist portion 116 and secured by engagement of the securing assembly elements 174 of the wrist securing assembly 172. Alternatively, the glove grip 130 may first be deployed on the glove core 102 and the assembled glove system 100 placed on the wearer's hand.

In some applications, the glove system 100 may be worn by the wearer as the wearer participates as a goalie in a soccer game. Accordingly, throughout repeated or prolonged periods of use, the glove grip 130 may wear out substantially sooner than the glove core 102. The glove grip 130 may thus be replaced by detaching the worn glove grip 130 from the glove core 102 typically by disengagement of the securing assembly elements 174 of the wrist securing assembly 172 and extending and removing the grip wrist portion strip 156 from the core wrist portion 116 of the glove core 102. The grip securing assembly 156 may be unfastened by disengagement of the grip securing elements 162 from the respective core securing elements 164 and the core digits 106 of the glove core 102 removed from the respective grip digits 134 of the glove grip 130. A replacement glove grip 130 may subsequently be deployed in place on the same glove core 102 typically as was heretofore described.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A two-part glove system comprising:

a glove core suitably sized and configured to enclose a wearer's hand;

a glove grip including a grip palm;

a grip securing assembly configured to facilitate detachable attachment of the glove grip to the glove core, the grip securing assembly comprising:

at least one securing assembly tab on the glove grip;

at least one grip securing element on the at least one securing assembly tab; and at least one core securing element on the glove core, the at least one grip securing element configured to detachably engage the at least one grip securing element, respectively, to facilitate detachable attachment of the glove grip to the glove core.

2. The two-part glove system of claim 1, wherein the at least one grip securing element on the at least one securing assembly tab of the glove grip is attached to the at least one companion core securing element on the glove core.

3. The two-part glove system of claim 1, wherein the glove grip includes a plurality of grip digits.

4. The two-part glove system of claim 3, wherein at least one grip securing element is provided on each securing assembly tab.

5. The two-part glove system of claim 1, wherein the glove core is padded.

6. The two-part glove system of claim 1, wherein the glove core includes a core rear panel, a core side panel which extends from the core rear panel, and a core front panel which extends from the core side panel.

7. The two-part glove system of claim 1, further comprising a core wrist portion which extends from the core palm of the glove core.

8. The two-part glove system of claim 7, wherein the core wrist portion is suitably sized and configured to encircle the wrist of the wearer.

9. The two-part glove system of claim 7, wherein the core wrist portion includes a core wrist portion strap.

10. The two-part glove system of claim 1, wherein grip digits extend from the grip palm.

11. The two-part glove system of claim 10, wherein the grip palm of the glove grip includes a grip backing.

12. The two-part glove system of claim 11, wherein each grip digit includes a corresponding digit sheath on the grip backing.

13. The two-part glove system of claim 12, wherein each digit sheath has a sheath interior sized and configured to receive the corresponding core digit of the glove core in deployment of the glove grip on the glove core.

14. The two-part glove system of claim 11, wherein the grip backing of the glove grip has a backing face which faces the glove core and a grip face which is opposite the backing face.

15. The two-part glove system of claim 10, wherein a grip wrist portion extends from the grip palm of the glove grip.

16. The two-part glove system of claim 15, wherein the grip wrist portion of the glove grip includes an elongated grip wrist portion strap.

17. The two-part glove system of claim 15 wherein a wrist securing assembly is provided on the grip wrist portion strap.

18. The two-part glove system of claim 1, wherein the at least one core securing element of the grip securing assembly is provided on a core rear panel of the glove core.

19. The two-part glove system of claim 1, wherein the at least one core securing element of the grip securing assembly is provided at the junction between a core palm and respective core digits of the glove core.

20. The two-part glove system of claim 1, wherein the grip securing elements and the core securing elements of the grip securing assembly include at least one of magnets, hook and loop fasteners, and/or snaps.

* * * * *